US005772561A

United States Patent [19]

Hayden

[11] Patent Number: 5,772,561

[45] Date of Patent: Jun. 30, 1998

[54] DUMBBELL SUPPORT ATTACHMENT FOR WEIGHT LIFTING BENCH

[76] Inventor: Richard C. Hayden, 1576 Heatherwood Dr., Decatur, Ga. 30033

[21] Appl. No.: 829,331

[22] Filed: Mar. 31, 1997

Related U.S. Application Data

[63] Continuation-in-part of Ser. No. 385,773, Feb. 9, 1995, Pat. No. 5,616,108.

[51] Int. Cl.[6] ..... A63B 13/00

[52] U.S. Cl. ..... 482/104; 482/106

[58] Field of Search ..... 482/104, 108, 482/148, 105, 106, 107, 142; 248/214, 300

[56] References Cited

U.S. PATENT DOCUMENTS

| | | | |
|---|---|---|---|
| D. 184,508 | 3/1959 | Burt | 248/300 |
| 1,541,128 | 6/1925 | Ennis | 248/300 |
| 2,612,273 | 9/1952 | Smith | 248/214 |
| 4,773,642 | 9/1988 | Cruz | 482/104 |
| 5,411,459 | 5/1995 | Hayden | 482/104 |
| 5,616,108 | 4/1997 | Hayden | 482/104 |

*Primary Examiner*—Jerome Donnelly
*Attorney, Agent, or Firm*—Harry I. Leon; Vivian L. Steadman

[57] ABSTRACT

A dumbbell support attachment which can be employed to modify a conventional weight lifting bench for use with dumbbells. A holder on which up to two dumbbells can be rested simultaneously at the beginning and end of an exercise routine is included in the attachment. This holder, which is part of a rack assembly which is rigidly attached to both a horizontal support bar and a pair of vertical mounting legs in the attachment, has a curved inner surface which opens upwardly and has a radius of curvature which is larger than that of the outer periphery of the heaviest dumbbell weights to be used. Generally "J"-shaped in transverse cross-section, the rack assembly includes an angular member rigidly attached to the horizontal support bar along its entire length and other features to strengthen it structurally. The holder itself defines two cutouts through which a user, as he lies on the weight bench, can reach to grab the dumbbell and lift it from its resting position. To modify the weight lifting bench for use with dumbbells, one simply removes each of its barbell supports from its respective support column and then inserts the vertical mounting legs into the support columns. Fixedly attached to the bar, the mounting legs are slideably insertable into the support columns of the bench.

7 Claims, 3 Drawing Sheets

DUMBBELL SUPPORT ATTACHMENT FOR WEIGHT LIFTING BENCH

This application is a continuation-in-part of Ser. No. 08/385,773, filed Feb. 9, 1995, now U.S. Pat. No. 5,616,108.

BACKGROUND OF THE INVENTION

This invention relates in general to exercise equipment and in particular to dumbbells for use while exercising. In the applicant's previous teachings, there is disclosed an attachment which can be hung from the horizontally-disposed crossbar of a barbell as it is being supported by a pair of vertical support columns commonly found in a standard weight-lifting bench. Used to support at least one dumbbell, this attachment works well with dumbbells of small to medium weight. With those of heavier weight, however, there is a tendency for the attachment to rotate about the crossbar since the attachment includes only a pair of tabs for preventing such rotation. Spanning a distance greater than that separating the two support columns, these tabs, which are small lateral extensions of the distal ends of the attachment, must abut the two support columns simultaneously. Otherwise, the tabs cannot function properly as rotational restraints.

SUMMARY OF THE INVENTION

The object of the present invention is to provide a dumbbell support attachment which is convenient to use, can be mounted on a typical weight lifting bench unmodified with respect to its weight support columns, and can be safely used to handle even the heaviest dumbbells.

The dumbbell support attachment according to the present invention includes a rack assembly, a horizontal support bar rigidly attached thereto, and a pair of vertical mounting legs. The mounting legs, which are spaced apart from each other, are fixedly connected to the distal ends of said support bar and are slideably insertable into the weight support columns of a typical weight lifting bench which are tubular in transverse cross-section.

In the preferred embodiment, the rack assembly is not only rigidly attached to the horizontal support bar but also to the vertical mounting legs. Below an angular member which is fixedly attached to the support bar, the rack assembly defines, in transverse cross-section, a "J"-shaped structure. The lower portion of this structure, or holder, includes at least three branches, each of which opens upwardly and has a curved inner surface with a radius of curvature which is larger than that of the outer periphery of the heaviest dumbbell weight to be used.

In the attachment, these three branches define two cutouts, each contiguous pair of branches being separated from the other by a distance which is shorter than the cross bar of the dumbbell in length but which is long enough to allow a person to easily put his hand through each of these cutouts. In use, any dumbbell resting on the attachment is positioned on the holder in such a way that the cross bar of the dumbbell is directly above one of these cutouts. Thus, an athlete, as he lies on the weightlifting bench, can reach through each of the cutouts to grab the cross bar of any dumbbell which may be present and lift it.

Means for adjusting the height of the attachment relative to the bench, according to a user's preference, includes each of the vertical mounting legs having a series of holes longitudinally spaced apart from each other and a pair of removable pins, each pin being engageable with a pair of openings in one of the vertical support columns of the bench, so that the vertical mounting legs can be held within the columns at one of a several different heights relative to the bench.

DETAILED DESCRIPTION OF THE PREFERRED EMBODIMENT

Figure 1:
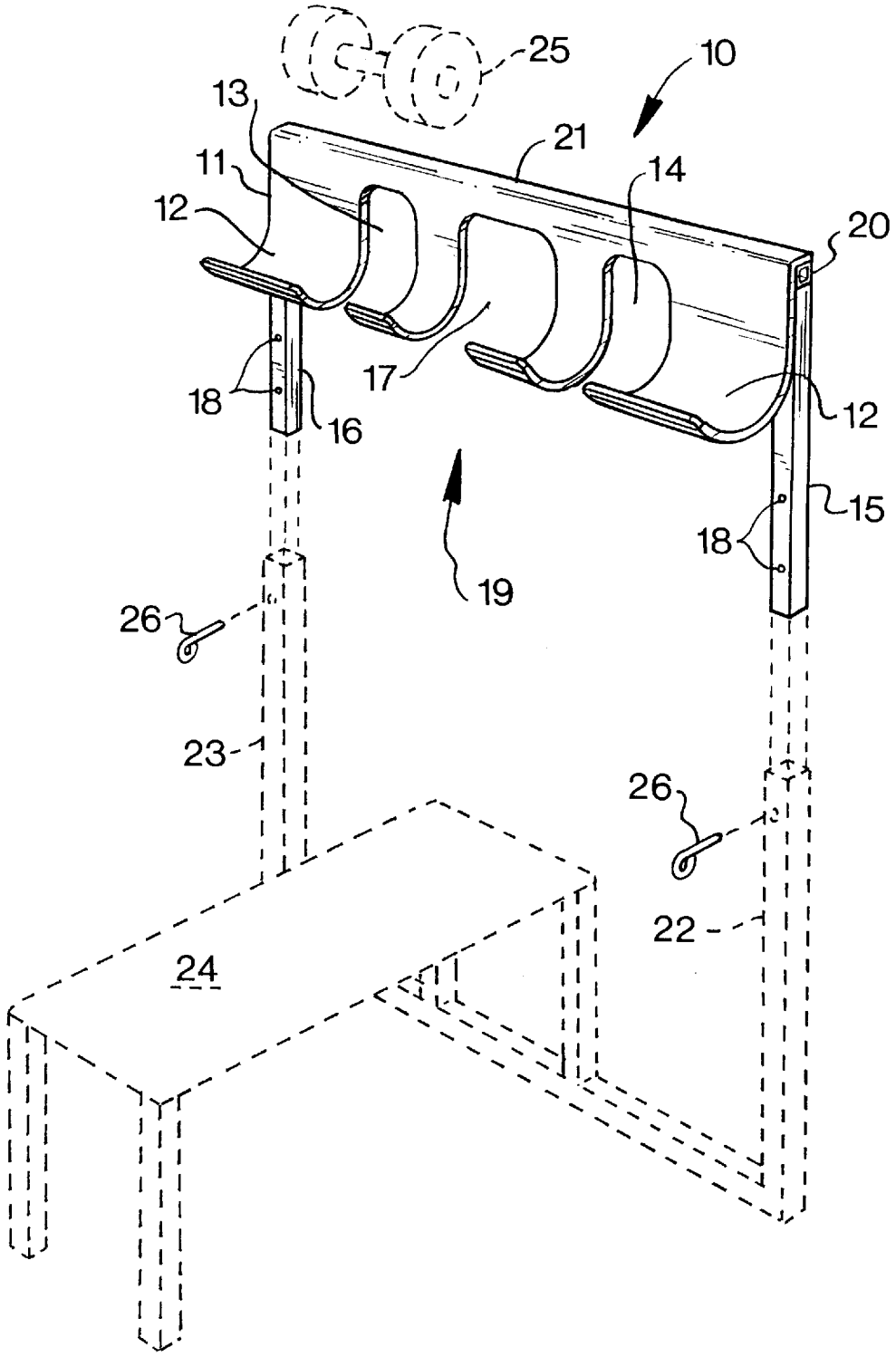
FIG. 1 is a perspective view of the dumbbell support attachment according to the present invention, the attachment being shown in position to be inserted into the tubular support columns of a weight lifting bench, the columns, dumbbell, and bench being shown in dashed lines for illustrative purposes only.

Referring to the drawing, an apparatus indicated generally by the reference number 10 is provided for supporting up to two dumbbells 25. The apparatus 10, which is intended to be used with a weight lifting bench 24 having two vertically-disposed tubular members 22, 23, comprises four basic elements, each fabricated of metal: a horizontal support bar 20, two vertical mounting legs 15, 16, and a rack assembly 19. Prior to use of the apparatus 10, any barbell supports or the like which may have been slideably inserted into the tubular members 22, 23 must first be removed.

Figure 2:
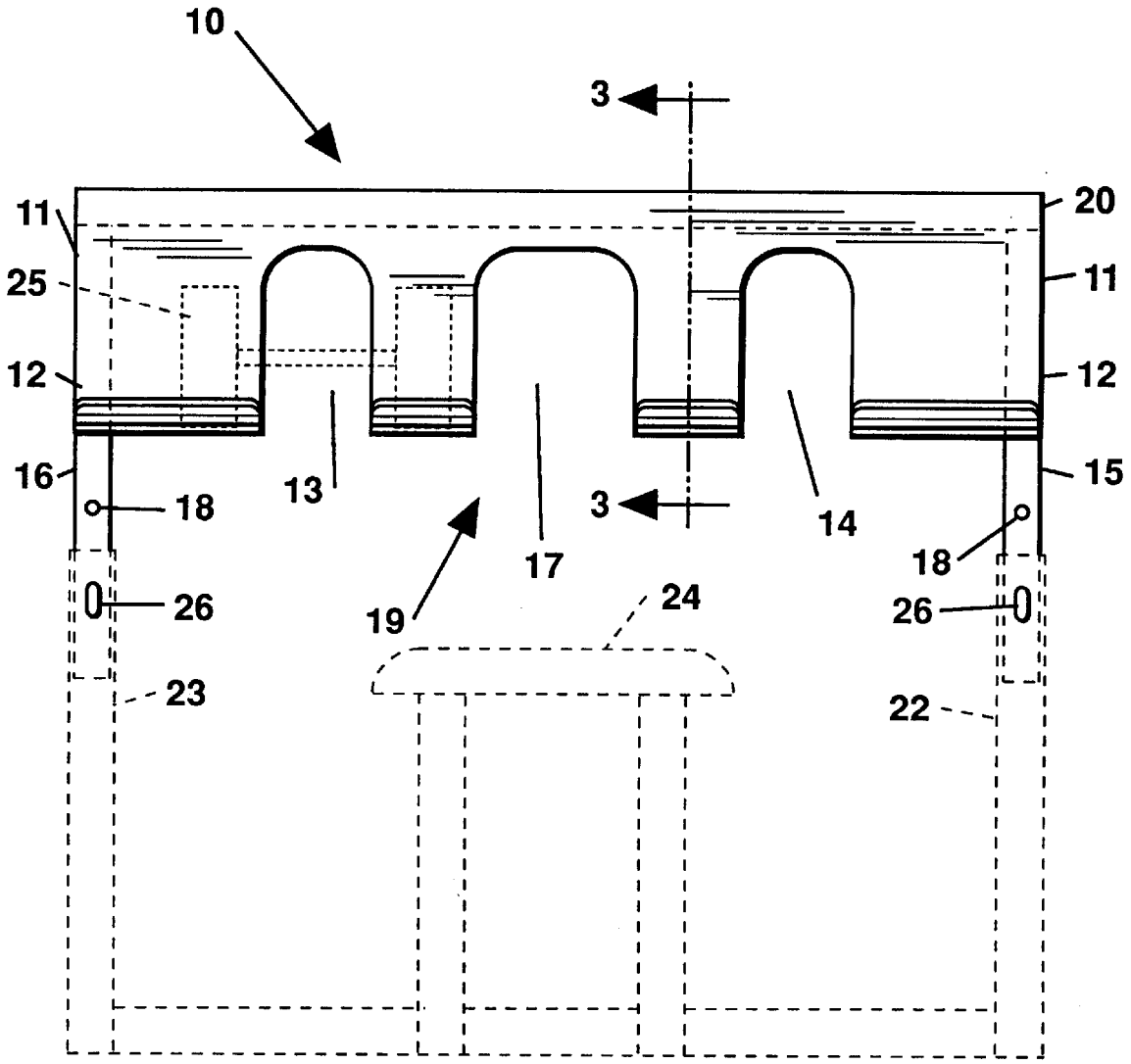
FIG. 2 is a front elevational view, on an enlarged scale, of the attachment according to FIG. 1.
Figure 3:
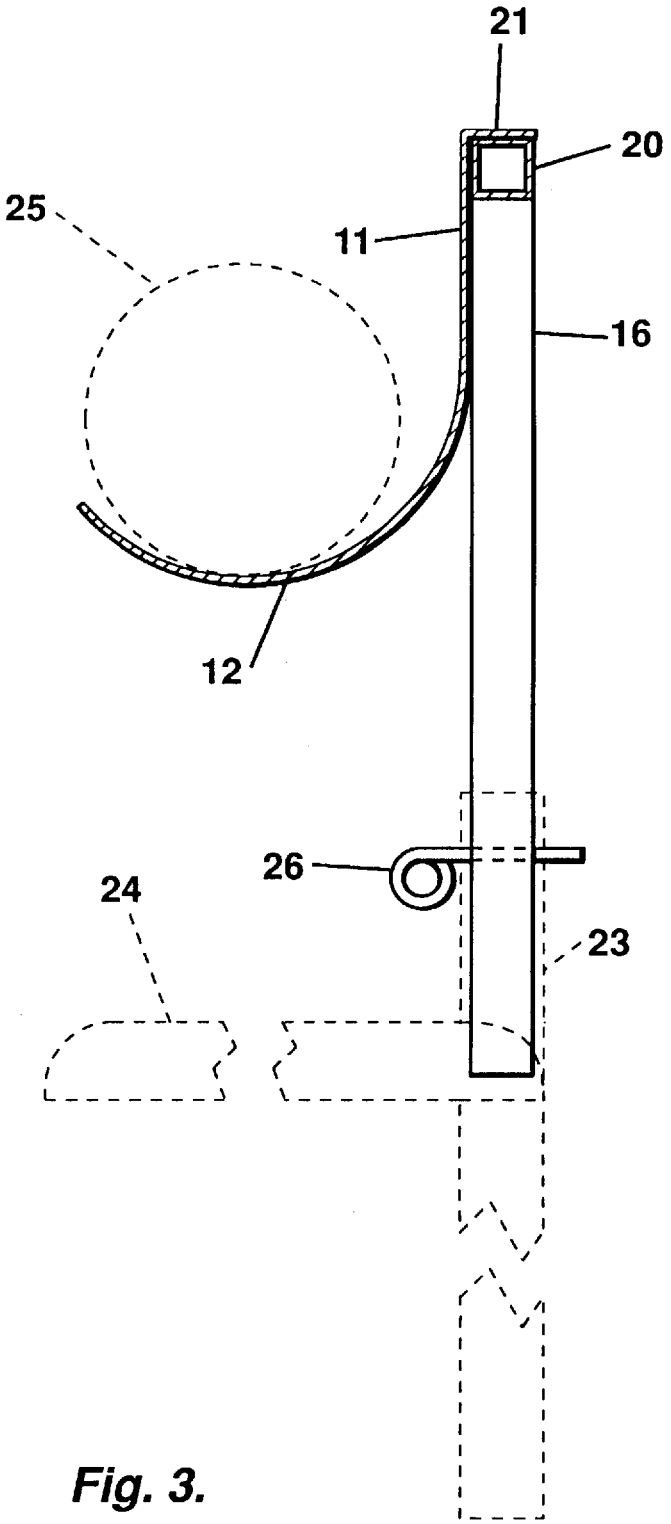
FIG. 3 is a cross-section, on a further enlarged scale, taken along line 3—3 of FIG. 2.

In the apparatus 10, the vertical mounting legs 15, 16 are rigidly attached to the distal ends of the bar 20 and provide means for mounting the bar on the tubular members 22, 23 (FIGS. 1 and 2). In order to allow the user to adjust the height of the bar 20 above the bench 24, each of the legs 15, 16 has a plurality of longitudinally spaced apart holes 18 formed therein, through which a pin 26, engageable with a pair of openings formed in each of the tubular members 22, 23, can be inserted to hold the leg and tubular member in assembled relation. In use, a pair of pins 26 engage holes 18 formed in the legs 15, 16 which in turn are aligned with openings in the tubular members 22, 23, respectively (FIGS. 1–3). Thus, the height of the apparatus 10 can be altered to suit the user by making adjustments similar to those which are commonly performed to adjust the heights of barbell supports.

In addition to the vertical mounting legs 15, 16, an angular member 21, which is part of the rack assembly 19, is rigidly attached to the horizontal support bar 20. In the preferred embodiment, the bar 20 is fabricated of an elongated tube formed of metal which is generally square in transverse cross-section; and the angular member 21 abuts the bar along two of its contiguous faces, the bar being rigidly attached to the angular member along its entire length.

As is illustrated in FIGS. 1–3, the assembly 19 also includes a straight vertical support arm 11 which is formed integrally not only with the angular member 21 but also with a holder 12. For extra strength, the support arm 11 is preferably rigidly attached to the vertical mounting legs 15, 16 (FIGS. 1 and 3).

Viewed from the side or, alternately, in transverse cross-section, the holder 12 and the support arm 11 together resemble a "J", the holder itself defining a semicircular structure. In the preferred embodiment, this semicircular structure has, by way of example, a radius of curvature of about 6 inches.

Viewed in elevation from the foot of the bench 24, the holder 12 is seen to be an elongated open tube which measures, by way of example, about 48 inches in length (FIG. 2). Segmented in at least three branches, the holder 12 defines a pair of open cutouts 13, 14 formed in the lower part of the open tube. Each of the cutouts 13, 14 is spaced apart from the other longitudinally and has a width which is similar to but shorter in length than the cross bar of the dumbbell 25 (FIGS. 1 and 2). In the preferred embodiment, the cutouts 13, 14 are spaced apart from each other about 24 inches; and the cutouts are each about 6 inches wide and 8 inches deep. To give a user extra visibility when handling the dumbbells 25, a view port 17 is preferably also provided between the cutouts 13, 14 (FIGS. 1 and 2).

The attachment 10 can be used to hold either one or two dumbbells 25 simultaneously. In use, each dumbbell 25 is placed in the holder 12 in such a way that the crossbar of the dumbbell is located directly above one of the cutouts 13, 14. During exercise, an athlete sitting or lying on the bench 24 reaches through the appropriate cutout 13, 14 and lifts the dumbbell 25 off of the holder 12. At the completion of his exercise routine, the athlete, inserting his hand through an unused cutout 13, 14, then returns each dumbbell 25 to the holder 12.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

It is claimed:

1. A support for a dumbbell having a pair of weights spaced apart from each other and mounted on a cross bar, the support being adapted for use with a weight lifting bench having two vertically-disposed tubular members between which the bench is disposed, comprising:

(a) a horizontal support bar;

(b) means, rigidly attachable to the two tubular members, for mounting the horizontal support bar thereon; and (c) an elongated structure which has first and second portions, the first portion being rigidly attached to the horizontal support bar; the second portion, in transverse cross-section, being disposed along a generally semi-circular curve, the structure defining at least three branches which are spaced apart longitudinally from each other, the branches in each contiguous pair of branches being separated from each other by a distance which is shorter than the cross bar of the dumbbell in length, each branch forming an upwardly concave surface when the first portion extends downwardly from the horizontal support bar, so that the weights of the dumbbell can rest on each contiguous pair of branches.

2. The support according to claim 1 wherein the elongated holder further defines a view port which is disposed between two branches.

3. The support according to claim 1 wherein the means for mounting the horizontal support bar further comprises a pair of vertical mounting legs, each of the legs being slideably insertable into one of the vertically-disposed tubular members.

4. A support for a dumbbell having a pair of weights spaced apart from each other and mounted on a cross bar, the support being adapted for use with a weight lifting bench having two vertically-disposed tubular members between which the bench is disposed, each tubular member having at least one pair of holes, comprising:

(a) a horizontal support bar;

(b) a rack assembly which is rigidly attached to the horizontal support bar, the rack assembly defining a structure which extends away from the horizontal support bar and which, in transverse cross-section, is distinctly J-shaped;

(c) means, rigidly attachable to the two tubular members, for mounting the horizontal support bar, the mounting means including a pair of vertical mounting legs rigidly attached to the horizontal support bar which are slideably insertable into the tubular members; and (d) means engageable with said pair of holes in each tubular member for adjusting securely one of the vertical mounting legs at various heights within the tubular member.

5. The support according to claim 4 wherein the rack assembly further defines at least three branches which are spaced apart longitudinally from each other, contiguous pairs of branches being separated from each other by a distance which is shorter than the cross bar of the dumbbell in length.

6. A support for a dumbbell having a pair of weights spaced apart from each other and mounted on a cross bar, the support being adapted for use with a weight lifting bench having two vertically-disposed tubular members between which the bench is disposed, comprising:

(a) a horizontal support bar;

(b) means, rigidly attachable to the two tubular members, for mounting the horizontal support bar, the mounting means including a pair of vertical mounting legs rigidly attached to the horizontal support bar which are slideably insertable into the tubular members; and (c) a rack assembly which is rigidly attached to the horizontal support bar, the rack assembly defining a structure which extends away from the horizontal support bar and which, in transverse cross-section, is distinctly J-shaped, each distal end of the rack assembly abutting one of said legs.

7. The support according to claim 6 wherein the rack assembly further defines at least three branches which are spaced apart longitudinally from each other, contiguous pairs of branches being separated from each other by a distance which is shorter than the cross bar of the dumbbell in length.

* * * * *